United States Patent [19]

Boser

[11] Patent Number: 4,497,270

[45] Date of Patent: Feb. 5, 1985

[54] METHOD AND APPARATUS FOR SEWING ELONGATED FABRIC PIECE

[75] Inventor: Ronald J. Boser, Dix Hills, N.Y.

[73] Assignee: Yoshida Kogyo K.K., Tokyo, Japan

[21] Appl. No.: 535,729

[22] Filed: Sep. 26, 1983

[51] Int. Cl.[3] ..... D05B 3/12; D05B 21/00; D05B 33/02

[52] U.S. Cl. ..... 112/265.2; 112/104; 112/114; 112/121.26; 112/121.29; 112/305; 112/152

[58] Field of Search ..... 112/265.2, 104, 113, 112/114, 121.26, 121.27, 121.29, 305, 152, 153

[56] References Cited

U.S. PATENT DOCUMENTS

| | | | |
|---|---|---|---|
| 2,862,467 | 12/1958 | Passaro et al. | 112/121.27 X |
| 3,381,639 | 5/1968 | Miller | 112/121.27 |
| 3,741,652 | 6/1973 | Frost et al. | 112/121.29 X |
| 3,780,682 | 12/1973 | Frost | 112/121.27 X |
| 4,111,137 | 9/1978 | Kirby | 112/121.29 X |
| 4,274,347 | 6/1981 | Rohrer | 112/104 |
| 4,343,255 | 8/1982 | Kelly et al. | 112/121.29 X |

*Primary Examiner*—H. Hampton Hunter
*Attorney, Agent, or Firm*—Hill, Van Santen, Steadman & Simpson

[57] ABSTRACT

An automatic apparatus for sewing elongated workpieces, and especially useful for precisely sewing a pair of concealed slide fastener stringers to a pair of fabric halves defining the opening therebetween comprises a table having fabric input guides at the front end of the table, a sewing station, and a gripper assembly for drawing the fabric pieces from the sewing station under a tension less than that applied by the sewing machine feed dog and presser foot. Individually actuable workpiece holders are provided to permit successive setting up of the fabric pieces in the sewing station. Fastener stringers are guided to the sewing station with their corded edges supported in guide channels as the stringers are superposed on the respective fabric piece. The sewing operation proceeds automatically in an extremely precise manner after the sewing station is inputed and the sewing machine started.

22 Claims, 8 Drawing Figures

IV
VI

METHOD AND APPARATUS FOR SEWING ELONGATED FABRIC PIECE

BACKGROUND OF THE INVENTION

This invention relates to automatic sewing of an elongated fabric workpiece, such as a curtain, a tent or a lady's dress, and, in particular, to a method and an apparatus for sewing a slide fastener to elongated fabric pieces.

It has been often necessary in sewing an elongated fabric workpiece to stitch together folded marginal edges of the fabric piece to prevent unraveling or to sew two pieces of fabric along their marginal edges with one superimposed on the other for joining them. In such known sewing operations, the steps of feeding the fabric workpiece into the sewing station of a sewing machine, positioning it in situ there, and withdrawing it therefrom are performed manually. Since an elongate workpiece is hard to handle, however, it is very difficult to carry out the above-mentioned three steps simultaneously and successively.

There is a significant drawback in that such sewing operations would require highly experienced dexterity on the part of an operator. Due to the reliance on manual handling during the sewing operation, another drawback is that aesthetically precise and effective sewing could not be expected of such operation.

When a slide fastener is attached to the opening in an elongated workpiece, such as a tent or a lady's dress; at first, one of the pair of stringers of the slide fastener is superposed on and sewn to one workpiece half defining the opening along its longitudinal edge, and, then, the other stringer is, likewise, superposed and sewn longitudinal edge. There arise the same drawbacks, and particularly sewing efficiency is very low.

SUMMARY OF THE INVENTION

A method and apparatus is presented for enabling automatic sewing of elongated fabric workpieces which avoids operator handling during the automatic sewing operation and affords a controlled set up and running of the sewing operation such that precise and efficient sewing reliably results regardless of operator experience or dexterity. A method and apparatus is also particularly presented which enables automatic sewing of a pair of slide fastener stringers simultaneously to both fabric halves defining the opening in such a precise and simple manner that even concealed zipper garments can be produced without wrinkling or unraveling.

Generally, the invention comprises a table having at a front end a fabric guidance means in the form of a linearly directed upstanding wall and a guide plate extending horizontally outward from the wall overlying the table travel path of the fabric. A sewing machine, having suitable presser foot and dog feed means, is mounted intermediate of the table. A releasable gripper device, for engaging a lead end of the fabric following commencement of the sewing operation and drawing the fabric rearward through the sewing machine under a tension less than that applied to the fabric by the feed means, is disposed adjacent the rear end of the table.

The sewing machine may be a double-needle type for permitting simultaneous side-by-side sewing of two fabric pieces passed together along opposed sides of the upstanding wall. A workpiece holder mechanism having separately actuatable feet permits successive loading of the fabric pieces and enables their suitable alignment prior to sewing.

A guideway means overlying the front end of the table and leading downward to the feed means permits conducting of a pair of slide fastener stringers into superposed relation on respective fabric halves for sewing. The guideway means includes guide channels for supporting the corded edges of the stringers for precise delivery onto the fabric edges prior to sewing. The guideway means also includes a slider detector assembly for terminating sewing operation before the slider reaches the sewing machine.

Other features and advantages to the present invention will be apparent upon reading of the following detailed description discussion.

DESCRIPTION OF THE PREFERRED EMBODIMENT

Figure 1:
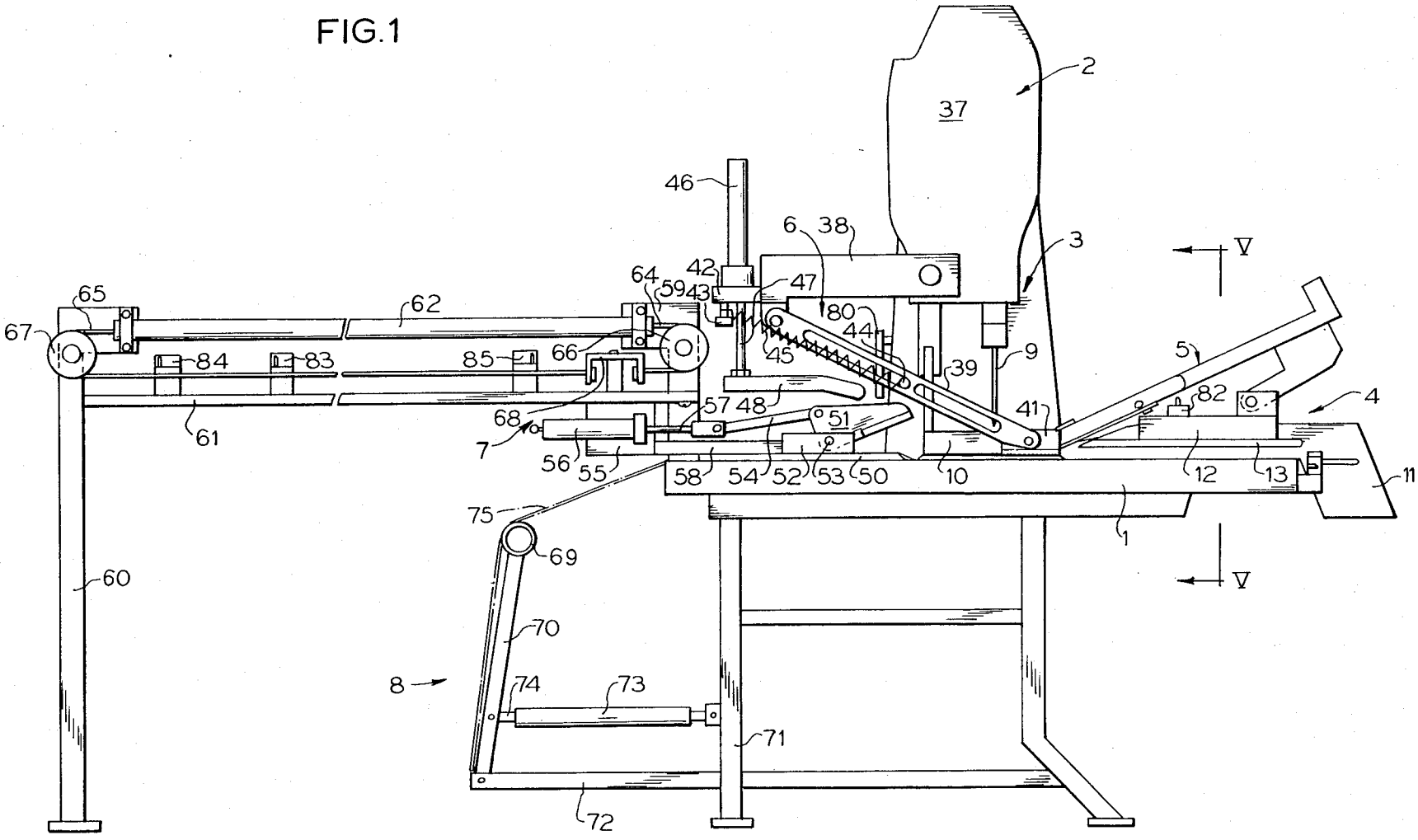
FIG. 1 is a front elevational view of a sewing apparatus constructed in accordance with the present invention.

This invention is especially useful for a wide variety of instances of sewing an elongated workpiece or simultaneous elongated workpieces. For illustration in the drawings and the following description as a preferred embodiment, an apparatus application designed for simultaneously sewing a pair of stringers of a concealed slide fastener to a pair of halves of an elongated fabric, such as a lady's dress, will be discussed.

As shown in FIG. 1, the invention apparatus broadly comprises a table 1, a sewing machine 2 mounted intermediately on the table 1 defining a sewing station 3, a fabric input guide 4 provided forward of the sewing station 3, a fabric strip (e.g., slide fastener) guideway 5 provided above the fabric guide 4, a fabric holder 6 provided rearward of and above the sewing station 3, a puller or gripper assembly 7 provided rearward of the sewing station 3 for linear movement, and a sewn fabric stacker 8 provided below the puller 7.

The construction of the sewing machine 2, itself, does not constitute any part of the invention. Any suitable type of sewing machine may be selected depending on what type of sewing operation will be desired. The sewing machine illustrated in this particular embodiment has double needles 9 and suitable foot and dog fabric feed means. Upon depression of a start button, a pressor foot 10 descends and the workpiece is lockstitched. Thereafter, the back tack stitch is effected, the thread is broken and finally the pressor foot ascends. Since such a sewing machine is of the type commonly put on the market and does not constitute any part of the invention, it is not necessary to go into further detail.

Figures 3, 4, 5, 6:
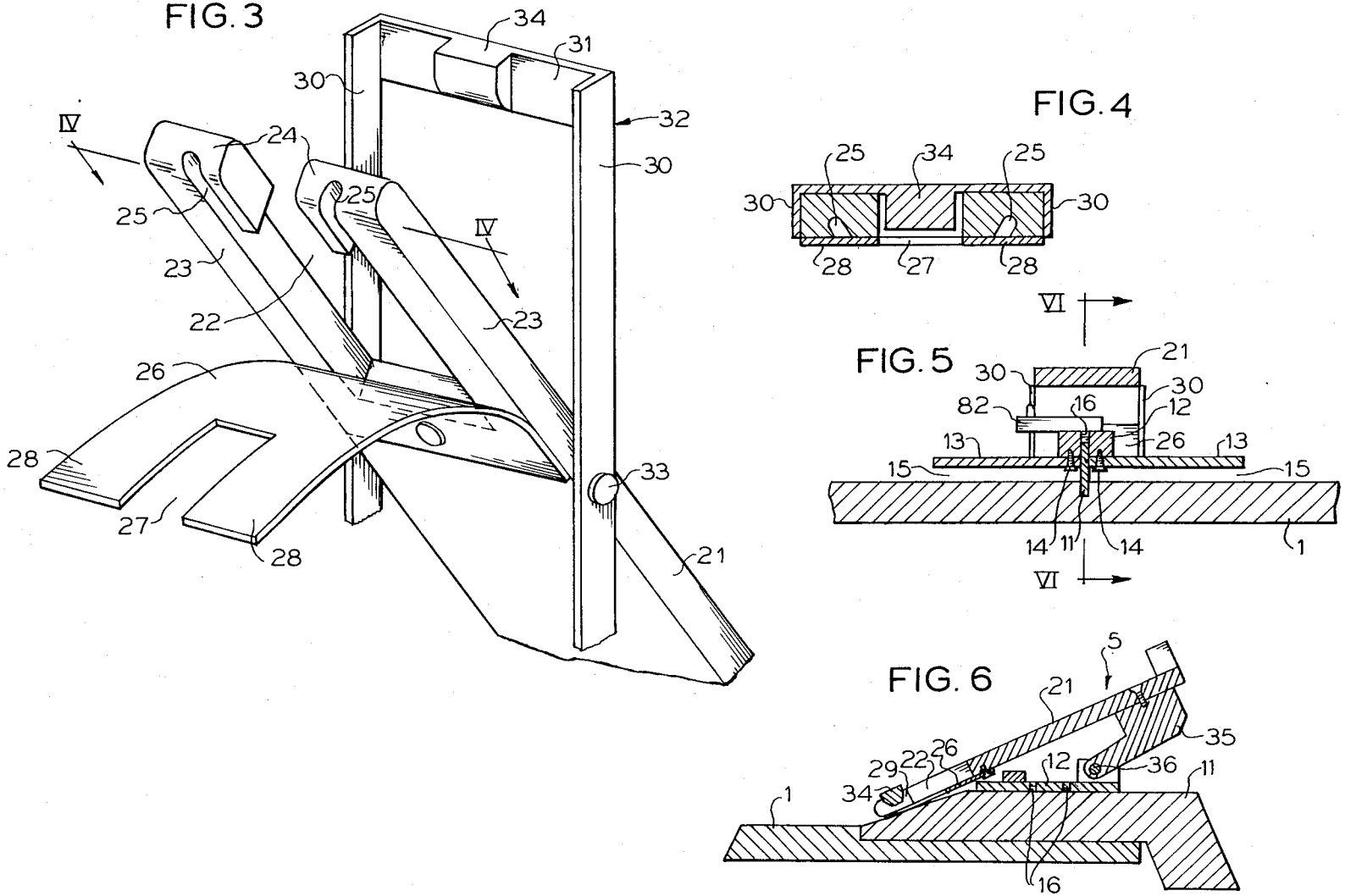
FIG. 3 is a fragmentary perspective view of a slide fastener guideway, with the component parts shown partially separated from each other for better illustration.
FIG. 4 is a cross-sectional view taken on line IV—IV, of FIG. 3, but with the component parts shown closed.
FIG. 5 is a cross-sectional view taken on line V—V of FIG. 1.
FIG. 6 is a cross-sectional view taken on line VI—VI of FIG. 5.

In order to guide and desirably align the confronting edges of a pair of opposed fabric workpiece halves, a vertical thin guidewall or plate 11 stands upwardly from the table and collinear with the imaginary center line of the sewing station 3, as shown in FIGS. 1, 5 and 6. The guide plate 11 is converged toward its rearward end and terminates slightly short of the pressor foot 10. The guide plate, at its front end, protrudes beyond the front edge of the table and is directed downwardly off the front edge of the table. Astride of the intermediate upper edge of the vertical guide plate is releasably mounted a bracket 12.

A pair of transparent horizontal guide plates 13 are fixed to the lower surface of the bracket 12 by means of screws 14 to extend outward from the vertical plate 11. A predetermined space is left between the guide plates 13 and the table 1 so as to provide a pair of opposed fabric guide channels 15. The height of the fabric guide channels can be adjusted by means of a pair of adjustable screws 16 depending on the thickness and the kind of fabric workpiece to be used.

Figure 2:
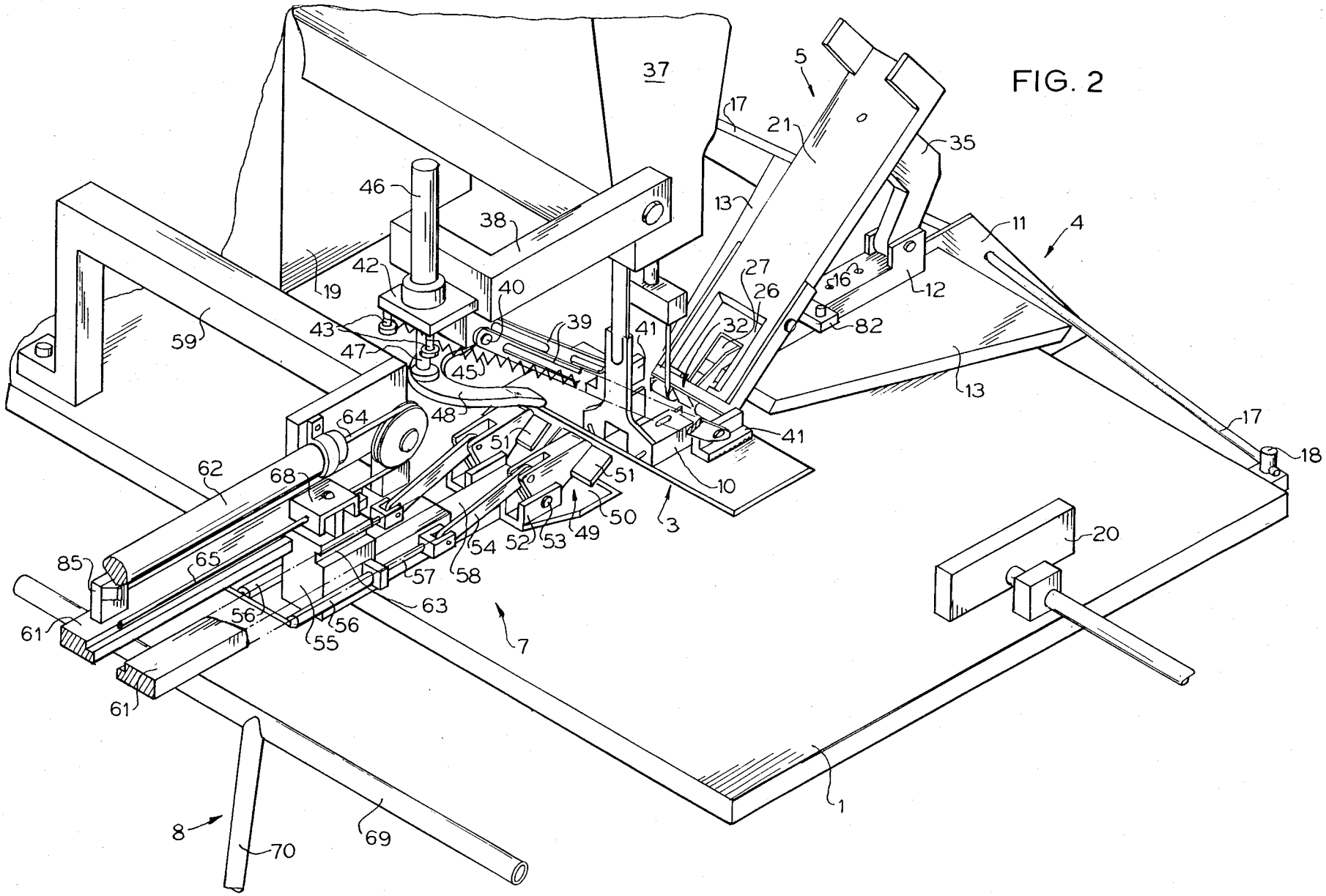
FIG. 2 is a fragmentary perspective view of the sewing apparatus shown in FIG. 1.

As shown in FIGS. 1 and 2, a pair of guide rods 17 are mounted at the front end of the table 1. Each guide rod has one end connected to the corresponding corner of the table 1 via a holder 18 in such a manner that the guide rod 17 is rotatable on a vertical axis. The other interior end of each guide rod 17 terminates slightly short of the protruded end of the vertical guide plate 11. The rod 17 lies substantially in coplanar relation to the upper surface of the table 1, and is set in inclined relation to the front edge of the table 1, so that a fabric workpiece half is prevented from tending to get diverted toward the vertical guide plate 11 where it could thereby get jammed into the fabric guide channel 15.

Figure 7:
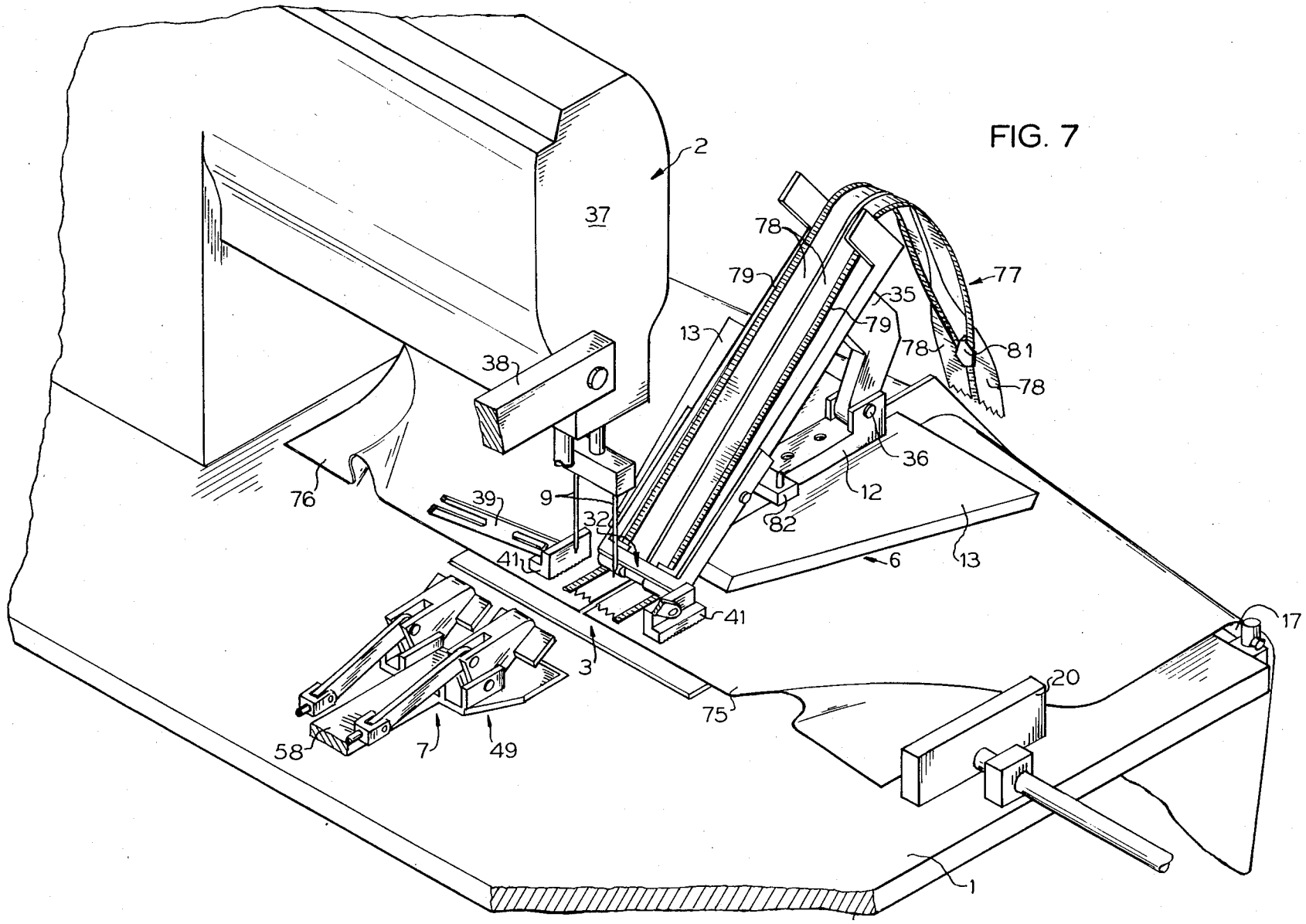
FIG. 7 is a fragmentary perspective view of the sewing apparatus, showing a pair of workpiece halves and a concealed slide fastener are set in position at the sewing station.

An adjustable guide surface 20 lies opposed to the sewing machine body 19 across the sewing station 3 and is adapted for moving toward and away from the sewing station 3. The surface 20 is disposed in symmetry with the sewing machine body 19, which serves as an opposed guide surface across the sewing station 3. The guide surface 20 functions to keep transportation resistance exerted upon the pair of workpiece halves 75, 76 uniform during movement through the sewing station, especially when workpiece halves of great width are sewn, as shown in FIG. 7.

As shown in FIGS. 1 and 2, the fabric strip guideway 5 is provided forward of the sewing station 3 and above the input guide 4 and disposed in inclined relation to the upper surface of the table 1. As shown in FIGS. 2 and 3, the guideway comprises a guide plate 21 having its lead end bifurcated by a rectangular opening 22 so as to provide a pair of projecting branches or legs 23. Disposed on the opposed interior lateral sides of the branches 23 are a pair of facing fastener element guides 24. Each branch 23 and fastener element guide 24 define therebetween a fastener element guide groove 25 which is open downwardly and slanted here laterally outward for handling a stringer to be used as a concealed stringer in a garment.

A rectangular leaf spring plate 26 has its one end attached to the lower surface of the guide plate 21 in such a way to cover the rectangular opening 22. The lead distal end of the leaf spring is, similarly, bifurcated by a rectangular recess 27 into a pair of separated projecting leaves 28 which leaves cover open bottoms of the fastener element guide grooves 25 respectively. As indicated from FIGS. 2 and 6, the above-mentioned opening 22, recess 27, the interspace interposed between both fastener element guides 24, and the coverged end of the vertical guide plate 11 are so physically and cooperatively related to each other as to define a slider guide channel 29. The slider being commonly attached to the stringers at a tail end thereof.

A slider detector 32 comprises a pair of side members 30 and an end member 31 connecting the side members at their ends so as to assume a U-shape. The slider detector 32 has its side members 30, 30 pivoted to the side walls of the guide plate 21 with pins 33, so that the slider detector 32 is pivotally mounted on the guide plate 21. Provided intermediately of the end member 31 is a cam 34 projecting downwardly. The cam 34 is normally positioned within and disposed for movement toward the above-mentioned slider guide channel 29. When the slider passes through the guide channel 29, the slider forces the cam 34 out of the slider guide channel 29, thereby rotating the slider detector 32 clockwise as viewed in FIG. 2.

The guide plate 21 is connected, at its other end, to the bracket 12 via an arm 35, which is pivoted to the bracket 12 by a bolt 36. The arrangement is such that the degree to which the fabric strip guideway is inclined relative to the table 1 can be adjusted by simply turning the arm 35 in either direction.

The relative position of the slide fastener to the sewing station 3 can be adjusted by simply attaching the bracket 12 in variable positions on the vertical guide plate 11.

The fabric holder 6 is employed for holding in situ each fabric workpiece individually as set by the operator at the sewing station until the sewing operation starts. As will be apparent from FIGS. 1 and 2, the sewing machine head 37 has a bracket 38 extending rearwardly therefrom. A pair of swing arms 39 are rotatably connected to the rear end of the bracket 38 by a pin 40. The swing arms 39 extend forwardly to the opposite sides, respectively, of the presser foot 10 at the sewing station 3, and the arms 39 have a pair of holding feet 41, 41 pivoted about lateral axes in the respective distal ends of the arms 39.

Figure 8:
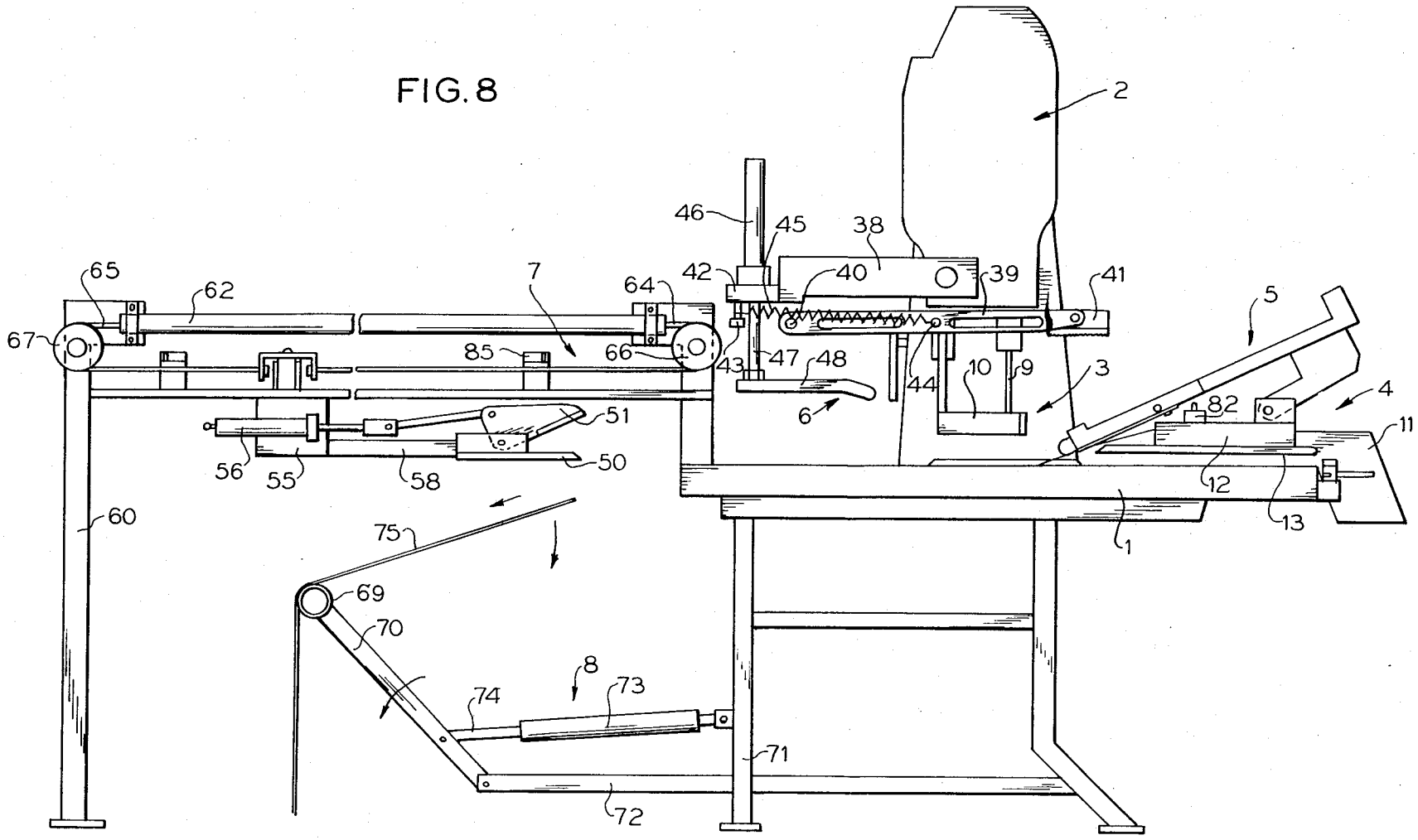
FIG. 8 is a front elevational view similar to FIG. 1, but mainly serves to illustrate how a stacker will function.

A horizontal plate 42 is integrally connected to the rear end of the bracket 38. A pair of screws 43 are screwed on the lower surface of the horizontal plate 42. Each of the swing arms 39 has its intermediate portion screwed by a screw 44 as shown in FIG. 1. A tension spring 45 has one end secured to the screw 44 of the swing arm 39 and the other end to the screw 43 of the horizontal plate 42, in such a manner that, when the arm 39 lies at a depressed position as shown in FIG. 1, the spring 45 lies below the pivotal pin 40; while, when the arm 39 lies at an elevated position as shown in FIG. 8, the spring 45 lies above the pivotal pin 40. This advantageously ensures that the foot 41 can be retained firmly and stably by the tension of the spring 45, either in the depressed position or in the elevated position.

An air cylinder 46 is provided on and vertically to the horizontal plate 42. A piston rod 47 reciprocally fitted in the air cylinder 46 is provided at its lower end with a horizontal C-shaped plate 48. The arrangement is such that, upon retraction of the piston rod 47, the ascending C-shaped plate 48 simultaneously strikes the pair of swing arms 39, thereby causing them to turn anti-clockwise, as viewed in FIG. 1, from the depression position to the elevated position for commencement of sewing operation.

The gripper assembly 7 is intended to impart a predetermined tension to the workpiece and the slide fastener during the sewing operation to promote and ensure uniform sewing and smooth lines. The gripper 7 also quickly withdraws the workpiece and slide fastener already sewn together after the sewing operation is terminated.

As shown in FIGS. 1 and 2, the gripper 7 includes a pair of grippers or fingers 49 for gripping the fabric workpiece and the slide fastener together. Each of the grippers 49 comprises a lower holding member 50 positioned slightly above the upper surface of the table 1 and an upper holding member 51 which is rotatably mounted by a pin 53 on a pair of vertical flanges 52 supported on the rear end of the lower holding member 50. Besides, the upper holding member is connected via a link 54 to the piston rod 57 of the corresponding one of a pair of air cylinders 56, 56. A slide 68 is interposed between and connected, at its both sides, to both piston rods 57, 57 of the cylinders 56, 56, respectively. With such construction, stretch of the piston rod 57 will cause the gripper 49 to close, while retraction of piston rod 57 will cause the gripper 49 to open. The lower holding member 50 is connected to a slide 55 via a connector 58 so that the gripper 49 will move together with the slide 55.

A cantilevered pillar 59 stands on the rear end of the table 1. A post 60 stands rearwardly of the sewing machine 2. Provided between the distal end of the cantilevered pillar 59 and the upper end of the post 60 are a pair of guide rails 61, 61 for linearly guiding the slide 55 therebetween and an air cylinder 62 for reciprocating the slide 55 along the guide rails 61. The opposed guide rails 61 have their respective inner edges so contoured as to slidably fit in the respective guide grooves 63 formed in the opposite sides of the slide 55. A wire 64 is fastened, at its one end, to the front end of the piston (not shown) fitted through the air cylinder 62, passes around a roller 66 provided on the cantilevered post 59 and is fastened, at the other end, to an anchor bracket 68 fixed to the top of the slide 55. The other wire 65 is fastened, at its one end, to the rear end of the piston (not shown), passes around a rear roller 67 provided on the top of the pillar 60 and is fastened, at the other end, to the anchor bracket 68 fixed to the top of the slide 55. Consequently, when the piston moves through the air cylinder 62 rightwards, as viewed in FIG. 1, this causes the slide 55 and hence the gripper 49 to move outwardly rearward from the sewing station 3, while the piston's moving leftwards causes the gripper 49 to move forwardly towards the sewing station 3.

As shown in FIG. 1, the stacker 8 is provided rearwardly of the sewing machine 2 and below the gripper assembly 7. The stacker 8 functions not only to stack finished fabric workpieces having already slide fasteners sewn thereto, but also to withdraw those finished workpieces fully away from the sewing stations and off the table 1 in cooperation with the gripper assembly 7 operation.

The stacker 8 embodiment here comprises a horizontal pipe 69 and a vertical leg 70 connected, at its top, to the middle of the horizontal pipe 69, so as to form a T-shape. A bracket 72 is integrally mounted on the frame 71 so as to extend rearwardly therefrom. The vertical leg 70 has its lower end pivotally connected to the rear end of the bracket 72. An air cylinder 73 has its bottom pivotally connected to the frame 71 of the table. A piston rod 74 reciprocably fitted in the air cylinder 73 has its top pivotally connected to the lower portion of the vertical leg 70. Consequently, stretch of the piston rod 74 through the air cylinder 73 causes the stacker 8 to turn counter-clockwise, as viewed in FIG. 1, while retraction of the piston rod 74 causes the stacker 8 to be rotated clockwise back toward the table.

Operation of the invention apparatus and method will now be described.

As shown in FIG. 7, before starting the sewing operation, an operator first introduces one workpiece half 75 over the guide rod 17 and along and through the fabric guide 4 into the sewing station 3, properly positions the workpiece half in situ there, and descends the fabric holder 6 thereby making its foot 41 retain the workpiece half 75 to the table 1. Then, the operator sets the other workpiece half on the table 1 in the same manner on the other side of the guide plate 11.

The operator then opens the slide fastener 77, places the fastener stringers 78, 78 on the fabric strip guideway 5 in an inverted disposition (to permit concealment when reversed back in the finished garment) as shown in FIG. 7, introduces the leading ends of the stringers through between the fastener element guide 24 and the leaf spring 26 into the sewing station 3, and superposes the leading ends of the stringers onto the already set workpiece halves. The corded or toothed edges 79 of the stringers 78 fit through the fastener element guide grooves 25 respectively, of the fastener element guide 24. The leaves of the leaf spring 26 function to maintain the positional stability of the fastener stringers 78 in the guide legs 24.

Upon depression of a start button (not shown), the presser foot 10 and the needles 9 descend, and the sewing operation starts. At the almost same time, the piston rod 47 of the air cylinder 46 reciprocates, so that the C-shaped horizontal plate 48 causes swing arms 39, 39 to turn counter-clockwise, as viewed in FIG. 1, against the tension of the spring 45, thereby lifting the holder feet 41 from the workpiece halves.

As the sewing operation proceeds, the leading ends of the fabric workpiece and slide fastener come into the space between the upper and lower holding members 50, 51 of the gripper 49. At this time, a photosensor 80 (see FIG. 1) fixed to the sewing machine 2 detects the lead ends of the slide fastener and workpiece and transmits a control signal so as to actuate the piston rod 57 of the air cylinder 56 to move rightwards, as viewed in FIG. 1. Thereby, the gripper 49 grips the superposed ends of the workpiece and the slide fastener and starts to draw them rearwardly from the sewing station 3 applying a predetermined tension less than that applied to the fabric by the sewing machine feed means. Drawing tension can be selected by adjusting the pressure of the air cylinder 62.

As the sewing operation proceeds, a slider 81 mounted on the slide fastener reaches the slider detector 32. Here, the slider causes, via engagement of the cam 34, the slider detector 32 to turn clockwise, as viewed in FIG. 7, thereby making its distal end hit a limit switch 82. With a signal transmitted by the limit switch 82, the sewing machine 2 starts to perform the back tack step. Then, after the thread is broken, the pressor foot 10 ascends and the sewing machine 2 comes to halt.

It is to be especially noted that the pressure of the air cylinder 62 is set to be less than the resistance applied to the workpiece and the slide fastener by the feed dog (not shown) and the presser foot 10 of the sewing machine 2, so that the gripper 49 returns in response to performance of the back tack step, comes into a temporary halt during the breakage of the thread, and, after the pressor foot 10 ascends, draws the workpiece and the slide fastener rearwardly faster than before.

When the slide 55 hits a limit switch 83, the piston rod 57 of the air cylinder 56 retracts, thereby spreading the holding members 50, 51 of the gripper 49, so that the workpiece and the slide fastener drop onto the horizontal pipe 69 of the stacker 8, as shown by an imaginary line in FIG. 1.

When the slide 55 hits a limit switch 84, the piston rod of the air cylinder 62 moves leftwards, as viewed in FIG. 1, and the piston rod 74 of the air cylinder 73 stretches. Consequently, the gripper 49 starts to be restored toward the sewing station 3, and the stacker 8 turns anti-clockwise, as viewed in FIG. 1, thereby positively withdrawing the tail end of the workpiece which, otherwise, might remain on the table therefrom.

When the slide 55 hits a limit switch 85, the supply of air to the air cylinder 62 comes to a halt, and the piston rod 74 of the air cylinder 73 retracts. Consequently, the slide 55 keeps moving to some extent under inertia and finally comes into abutment against suitable stop (not shown) to the forward stroke position, whereby the gripper 49 is restored to its original open or receiving position and, likewise, the stacker is restored to the original position.

The apparatus is now ready for the operator to start another cycle by inputing another slide fastener and another fabric workpiece, both of which are in the form of separate halves.

The embodiment herein specifically described relates to sewing a pair of stringers for a concealed slide fastener garment to a pair of fabric workpiece halves simultaneously. Should the apparatus be intended for an ordinary slide fastener instead of a concealed slide fastener, the construction of the fabric strip guideway 5 could readily be adapted for the purpose. Should the apparatus be intended for jobs sewing a folded marginal edge of a piece of fabric or sewing together two pieces of fabric along a place where one is superposed on the other, it would not be necessary to provide the apparatus with the guideway 5, and a single fabric guide channel would be satisfactory.

Although various minor modifications may be suggested by those versed in the art, it should be understood that I wish to embody within the scope of the patent warranted hereon all such modifications as reasonably and properly come within the scope of my contribution to the art.

I claim as my invention:

1. Apparatus for sewing elongated workpieces comprising a table on which is mounted guide surface means at a front end of said table, a sewing machine disposed intermediate of said table, and a releasable gripper means disposed via drive means for linear back and forth movement between respective forward and rearward stroke positions adjacent said sewing machine and outward away from the rear end of said table, said sewing machine having feed means for conducting a workpiece from said guide surface means, through said sewing machine, and toward said gripper means during operation of said sewing machine, said gripper means engaging a lead end of said workpiece and said drive means drawing said gripper means rearwardly under tension less than that applied to said workpiece by said feed means.

2. The apparatus of claim 1, further comprising a workpiece holder means mounted in said table having a vertically movable foot for descending on the lead end of said workpiece to retain said lead end fixed on said table over said feed means prior to sewing operation and raising upward to release said lead end upon commencement of sewing operation.

3. The apparatus of claim 1, further comprising means for activating said gripper means to grip said lead end of said workpiece subsequent to commencement of said sewing operation.

4. The apparatus of claim 3, wherein said means for activating comprises a photosensor disposed rearward of said feed means for generating a control signal upon detection of rearward movement of said lead end past said feed means, and said gripper means comprises pivotally closable upper and lower finger members defining a workpiece-receiving space therebetween and motor means for closing together said finger means responsive to said control signal.

5. The apparatus of claim 1, wherein said gripper means releases said workpiece lead end at its rearward stroke position and further comprising a stacker means adjacent the rear end of said table for receiving thereon the released lead end of said workpiece, said stacker means being rearwardly movable for drawing the trailing end of said workpiece from said sewing machine after release of said workpiece by said gripper means.

6. The apparatus of claim 1, further comprising a downwardly inclined guideway means disposed on said table over said guide surface means and having a lower lead end facing said feed means for conducting a fabric strip workpiece in superposed fashion onto said elongated workpiece for being sewn together by said sewing machine.

7. The apparatus of claim 6, wherein said fabric strip is a slide fastener stringer having a slider at its trail end, and said guideway means comprises a plate portion formed with a discharge opening at the lead end of said guideway means through which said slide fastener stringer passes to said feed means, a detector arm pivotally mounted on said plate portion and formed with a cam disposed for movement overlying and toward said discharge opening, and a switch means for being triggered by movement of said detector arm when said slider engages said cam in said discharge opening to commence termination of the operation of said sewing machine.

8. The apparatus of claim 7, wherein said plate portion is disposed on said table by means for adjusting the inclination angle thereof.

9. The apparatus of claim 7, wherein said plate portion lead end is formed with a guide adjacent said discharge opening, said guide having a longitudinally extending, downwardly open guide groove for supporting a corded edge of said slide fastener stringer therethrough, and a means for maintaining said corded edge in said guide groove during passage of said slide fastener stringer to said feed means.

10. The apparatus of claim 6, wherein said guide surface means, gripper means, and guideway means are adapted for simultaneously receiving and conducting two separate elongated and fabric strip workpieces for side-by-side sewing in said apparatus.

11. The apparatus of claim 10, wherein at least one laterally adjustable guide wall means is disposed on said table for maintaining symmetrical transport resistance between said two elongated workpieces during conduct of said elongated pieces through said sewing machine.

12. The apparatus of claim 1, further comprising guide rod means extending outward from said front end of said table for receiving thereover said elongated workpiece and preventing said elongated workpiece from tending to jam against said guide surface means.

13. Automatic apparatus for sewing a pair of slide fastener stringers to a pair of elongated fabric halves comprising a table on which is mounted an upstanding linearly directed guidewall at a front end of said table, a double-needle sewing machine disposed intermediate of said table having feed means for receiving and conducting said pair of fabric halves from along sides of said guidewall, beneath said sewing machine needles, and toward a rear end of said table, a releasable gripper means disposed via drive means for linear back and forth movement between respective forward and rearward stroke positions adjacent said feed means and outward away from the rear end of said table, said gripper means gripping respective lead ends of said fabric halves simultaneously, an inclined guideway means for conducting a separated pair of slide fastener stringers downward toward said feed means for respective superposed placement onto said pair of fabric halves, and said drive means draws said gripper means rearward during operation of said sewing machine at a tension less than that applied to the fabric halves by said feed means.

14. The automatic apparatus of claim 13, wherein said guideway means is formed with a discharge opening at its lower lead end defined between a pair of leg portions, each having a longitudinally extending, downwardly open guide groove for supporting a corded edge of one corresponding slide fastener stringer therethrough and a means for maintaining said corded edges in said guide grooves during passage of said slide fastener stringers to said feed means.

15. The automatic apparatus of claim 13, further comprising a pair of separately actuatable holder means disposed on said table, each having a vertically movable foot for descending onto a lead end of a respective fabric half adjacent one opposed corresponding side of said feed means, to retain said fabric halves lead ends fixed on said table in an aligned manner prior to operation of said sewing machine and means for simultaneously raising said holder means feet upon commencement of operation of said sewing machine.

16. The automatic apparatus of claim 13, wherein said pair of slide fastener stringers has a common slider at a tail end thereof, and said guideway means comprises a plate portion formed with a discharge opening at the lead end of said guideway means through which said slide fastener stringers pass to said sewing machine, a detector arm pivotally mounted on said plate portion and formed with a cam disposed for movement overlying and toward said discharge opening, and a switch means for being triggered by movement of said detector arm when said slider engages said cam in said discharge opening to commence termination of the operation of said sewing machine.

17. A method for operating an apparatus for automatically sewing elongated workpieces, said apparatus comprising a table on which is mounted a linearly directed, upstanding guidewall at a front end of said table, a sewing machine disposed intermediate of said table, and a releasable gripper means disposed via drive means for linear back and forth movement between respective forward and rearward positions adjacent said sewing machine and outward away from said rear end of said table, said sewing machine having feed means for conducting a workpiece through said sewing machine in a rearward linear direction, said method comprising:

passing said workpiece along said guidewall such that a leading end thereof engages said feed means, clamping said leading end of said workpiece in situ on said feed means, operating said sewing machine, including said feed means, while substantially simultaneously removing the clamping of said leading end of said workpiece, gripping the leading end of said workpiece as it is conducted rearwardly of said feed means, and drawing said gripped workpiece rearwardly away from said table via said drive means with a tension less than that applied to said workpiece by said feed means.

18. The method of operating of claim 17, further comprising:

providing a stacker means adjacent the rear end of said table and underlying said gripper means, releasing the gripped leading end of said workpiece upon termination of said sewing machine operation, dropping said leading end of said released workpiece onto said stacker, and moving said stacker in a rearward direction for conducting the trailing end of said workpiece fully away from said sewing machine.

19. A method for sewing a pair of slide fastener stringers to a pair of elongated fabric halves comprising:

passing a pair of fabric halves separated by an opening to a sewing machine, fixably holding adjacent lead ends of said fabric halves on a feed means of said sewing machine, providing an inclined guideway ramp for overlying the opening between said fabric halves with a lower end thereof facing onto said feed means, opening a pair of slide fastener stringers such that the corded edges thereof face oppositely of one another, directing said inverted slide fastener stringers along said guideway ramp such that lead ends of said stringers are superposed on the lead ends of said fabric halves respectively, threading said corded edges of said stringers through guide channel means formed on said guideway ramp, releasing the hold on said lead ends of said fabric halves and simultaneously commencing operation of said sewing machine, including said feed means.

20. The method of claim 19, further comprising:

positively gripping the lead ends of said fabric halves as said sewn fabric halves and stringers exit from said feed means of said sewing machine, positively conveying said gripped lead ends of said fabric halves linearly rearward from said feed means with a tension less than that applied to said fabric halves by said feed means.

21. The method of claim 20, further comprising:

releasing the grip on said lead ends of said fabric halves simultaneously with termination of said sewing machine operation, including said feed means, providing a stacker means rearward of said sewing machine and underlying the rearward transport of said fabric halves when they are being gripped, dropping the lead ends of said released fabric halves onto said stacker means, and indexing said stacker means in a rearward direction from said feed means to draw the tail ends of said fabric halves rearward fully away from said feed means.

22. The method of claim 20, further comprising:

providing a common slider connected to and disposed at the tail ends of said pair of stringers, providing slider detector means at the lower lead end of said guide way ramp and terminating operation of said sewing machine in response to said slider detector means detecting the presence of said slider at the lower lead end of said guide way ramp.

* * * * *